US005733102A

United States Patent [19]

Lee et al.

[11] Patent Number: 5,733,102

[45] Date of Patent: Mar. 31, 1998

[54] SLOT COOLED BLADE TIP

[75] Inventors: Ching-Pang Lee, Cincinnati; Gulcharan S. Brainch, West Chester; Anne M. Isburgh, Loveland, all of Ohio

[73] Assignee: General Electric Company, Cincinnati, Ohio

[21] Appl. No.: 767,905

[22] Filed: Dec. 17, 1996

[51] Int. Cl.[6] ..... F01D 5/18; F01D 5/20

[52] U.S. Cl. ..... 416/97 R; 416/92; 415/115; 415/173.1; 415/173.4

[58] Field of Search ..... 415/115, 116, 415/173.1, 173.4, 173.5, 173.6; 416/92, 96 R, 96 A, 97 R, 97 A, 224, 241 R, 241 B

[56] References Cited

U.S. PATENT DOCUMENTS

| | | | |
|---|---|---|---|
| 3,810,711 | 5/1974 | Emmerson et al. . | |
| 3,899,267 | 8/1975 | Dennis et al. | 416/92 |
| 4,142,824 | 3/1979 | Andersen . | |
| 4,390,320 | 6/1983 | Eiswerth . | |
| 4,761,116 | 8/1988 | Braddy et al. | 416/97 R |
| 4,863,348 | 9/1989 | Weinhold | 415/173.1 |
| 5,156,526 | 10/1992 | Lee et al. | 416/97 R |
| 5,238,752 | 8/1993 | Duderstadt et al. . | |
| 5,326,224 | 7/1994 | Lee et al. . | |
| 5,334,263 | 8/1994 | Schaeffer . | |

OTHER PUBLICATIONS

General Electric Company, "Ceramic Coated Blade Squealer Tip," in production (public use greater than one year).

*Primary Examiner*—Christopher Verdier
*Attorney, Agent, or Firm*—Andrew C. Hess; Patrick R. Scanlon

[57] ABSTRACT

A turbine blade includes an airfoil having an internal cooling circuit therein. The airfoil extends from a root to a tip cap, and includes laterally opposite pressure and suction sides extending between a leading edge and an opposite trailing edge over which is flowable a combustion gas. A pair of squealer tips extend radially upwardly from the tip cap along the pressure and suction sides, and are spaced apart between the leading and trailing edges to define an upwardly open tip cavity. At least one of the squealer tips includes a slot extending radially inwardly to the tip cap, with the slot also extending along the squealer tip between the leading and trailing edges. A plurality of spaced apart supply holes extend radially through the tip cap in the slot in flow communication with the cooling circuit for channeling the coolant into the slot for cooling the squealer tip. A thermal barrier coating may then be disposed on an outboard side of the squealer tip for providing insulation against the combustion gas flowable therealong.

11 Claims, 3 Drawing Sheets

SLOT COOLED BLADE TIP

BACKGROUND OF THE INVENTION

The present invention relates generally to gas turbine engines, and, more specifically, to turbine blade tip cooling.

A gas turbine engine includes a compressor for pressurizing air which is mixed with fuel in a combustor and ignited for generating hot combustion gas which flows downstream through one or more stages of turbine blades. The turbine blades extract energy from the combustion gas for powering the compressor and providing output power.

Since the turbine blades are directly exposed to the hot combustion gas, they are typically provided with internal cooling circuits which channel a coolant, such as compressor bleed air, through the airfoil of the blade and through various film cooling holes around the surface thereof.

The airfoil extends from a root at a blade platform, which defines the radially inner flowpath for the combustion gas, to a radially outer tip cap, and includes opposite pressure and suction sides extending axially from leading to trailing edges of the airfoil. The cooling circuit extends inside the airfoil between the pressure and suction sides and is bounded at its top by the airfoil tip cap.

Typically extending radially outwardly from the top of the tip cap are a pair of squealer tips in the form of small ribs which extend around the perimeter of the airfoil on the tip cap. The squealer tips are laterally spaced apart between the leading and trailing edges to define an upwardly open tip cavity.

The squealer tips define short radial extensions of the airfoil which are spaced closely radially adjacent to an outer turbine shroud to provide a relatively small clearance gap therebetween. During operation, the turbine blades rotate within the shroud, with the squealer tips providing an effectively small seal with the shroud for minimizing leakage of the combustion gas therebetween. Due to differential thermal expansion between the blade and the shroud, the squealer tips may rub against the turbine shroud and abrade. Since the squealer tips extend radially above the tip cap, the tip cap itself and the remainder of the airfoil is protected from damage, which maintains integrity of the turbine blade and the cooling circuit therein.

However, since the squealer tips are solid metal projections of the airfoil, they are directly heated by the combustion gas which flows thereover, and are cooled primarily by limited heat conduction into the tip cap with the heat then being removed by convection in the coolant circulating within the airfoil. The squealer tips, therefore, operate at elevated temperatures above that of the remainder of the airfoil and limit the effectiveness of the airfoil in a hot turbine environment.

A thermal barrier coating (TBC) is a proven thermal insulator used at various locations in gas turbine engines. However, TBC is effective only at locations in the engine where heat flux is high due to differential temperature between hot and cold sides of a component. Since a typical squealer tip is directly bathed on both its inboard and outboard sides in the combustion gas, it has a relatively low heat flux laterally therethrough which decreases the effectiveness of TBC applied on the outboard side thereof.

Since the pressure side of an airfoil typically experiences the highest heat load from the combustion gas, a row of conventional film cooling holes is typically provided in the pressure side immediately below the tip cap for providing a cooling film which flows upwardly over the pressure side squealer tip. Although this enhances cooling of the pressure side squealer tip, it also effects a relatively large radial temperature gradient from the top of the squealer tip down to the tip cap near the film cooling holes. A large temperature gradient in this direction creates thermal stress which over repeated cycles of operation of the engine may lead to metal cracking that limits the effective life of the blade.

In order to reduce this undesirable radial thermal gradient in the squealer tips, the blade tip may be masked during the TBC coating process to eliminate TBC along the outboard side of the squealer tip, while maintaining TBC over the remainder of the outer surface of the airfoil. In this way, the entire squealer tip is operated without TBC protection to reduce the undesirable radial temperature gradient. However, the masking process in the manufacture of the turbine blades significantly increases the cost of manufacture which is undesirable. It is therefore desired to eliminate the masking process while still providing effective cooling of blade squealer tips when used in conjunction with TBC.

SUMMARY OF THE INVENTION

A turbine blade includes an airfoil having an internal cooling circuit therein. The airfoil extends from a root to a tip cap, and includes laterally opposite pressure and suction sides extending between a leading edge and an opposite trailing edge over which is flowable a combustion gas. A pair of squealer tips extend radially upwardly from the tip cap along the pressure and suction sides, and are spaced apart between the leading and trailing edges to define an upwardly open tip cavity. At least one of the squealer tips includes a slot extending radially inwardly to the tip cap, with the slot also extending along the squealer tip between the leading and trailing edges. A plurality of spaced apart supply holes extend radially through the tip cap in the slot in flow communication with the cooling circuit for channeling the coolant into the slot for cooling the squealer tip. A thermal barrier coating may then be disposed on an outboard side of the squealer tip for providing insulation against the combustion gas flowable therealong.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
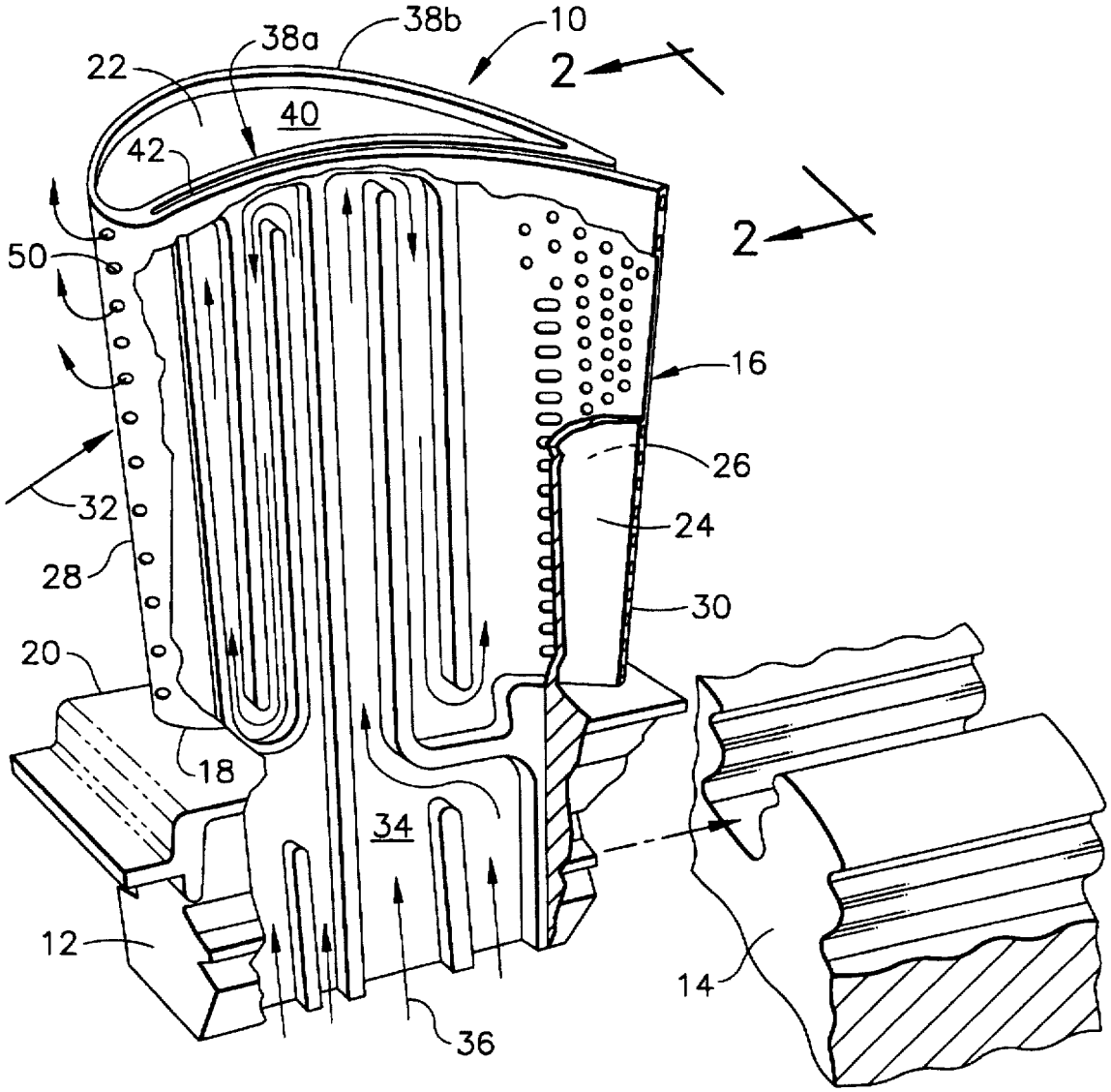
FIG. 1 is a partly sectional, isometric view of an exemplary gas turbine engine turbine blade having a cooled airfoil and blade tip in accordance with an exemplary embodiment of the present invention.

Illustrated in FIG. 1 is an exemplary gas turbine engine turbine rotor blade 10 configured for use as a first stage high pressure turbine blade. The blade 10 includes a conventional dovetail 12 having suitable tangs for mounting the blade in corresponding dovetail slots in the perimeter of a rotor disk 14 shown in part.

The blade 10 further includes an airfoil 16 having a root 18 joined to the dovetail 12, an integral platform 20, and a radially opposite tip cap 22. The airfoil 16 also includes laterally opposite pressure and suction sides 24, 26 extending between a leading edge 28 and an opposite trailing edge 30 from the root to the tip cap, and over which is flowable hot combustion gas 32 produced in a combustor (not shown).

The airfoil 16 further includes an internal cooling channel or circuit 34 which extends from the tip cap 22 to the root and through the dovetail 12 for circulating or channeling a suitable coolant 36, such as air which may be bled from a conventional compressor (not shown) for cooling the blade 12.

Except as further described hereinbelow, the blade 10 may have any conventional configuration and is typically formed as a one-piece casting of the dovetail 12, airfoil 16, and platform 20 of a suitable high temperature metal such as nickel-based superalloys in a single crystal configuration which enjoys suitable strength at high temperature operation.

In accordance with one embodiment of the present invention, the airfoil 16 further includes a pair of squealer tips 38*a,b* which extend radially upwardly from the tip cap 22 along respective ones of the pressure and suction sides 24, 26 and may be integrally formed or cast therewith. The squealer tips 38*a,b* are spaced laterally apart between the leading and trailing edges 28, 30 at the tip cap 22 to define an upwardly open tip cavity 40 which is substantially continuous between the pressure and suction sides of the airfoil between the corresponding two squealer tips.

In order to provide enhanced cooling in accordance with the present invention, at least one of the squealer tips has a single, upwardly open slot 42 extending radially inwardly from a common top or radially outer surface of the squealer tip to the tip cap 22. The pressure side 24 of the airfoil, which is generally concave, typically experiences the highest heat load from the combustion gas 32 which flows thereover, as compared to the suction side 26, which is generally convex. Accordingly, the slot 42 is preferably disposed in the pressure side squealer tip 38*a*, and extends therealong from about the leading edge 28 to about the trailing edge 30. The axial or chordal extent of the slot 42 is selected for each design application for providing effective cooling of the squealer tip in regions of relatively high heat load.

Figure 2:
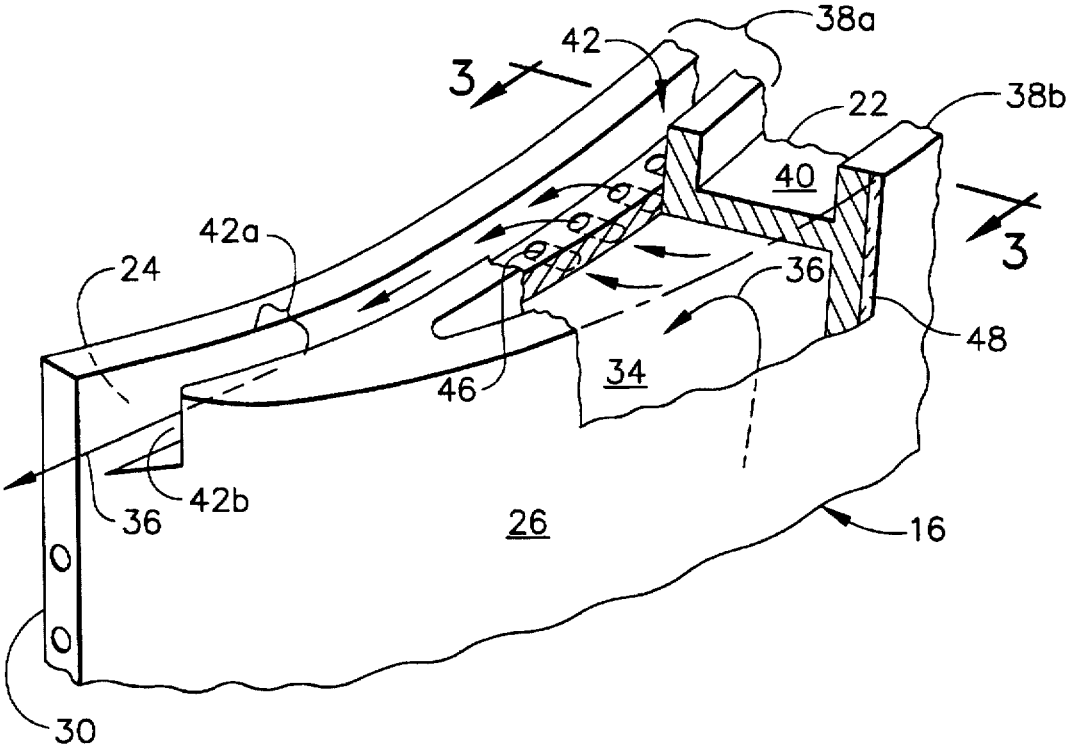
FIG. 2 is an aft-facing-forward view of a trailing edge portion of the airfoil illustrated in FIG. 1 at the blade tip and taken along line 2—2.

The trailing edge portion of the two squealer tips 38*a,b* is illustrated in more particularity in FIG. 2. The slot 42 in the pressure squealer tip 38*a* bifurcates squealer tip into two inboard and outboard portions. The squealer tip 38*a* nevertheless operates as a single squealer tip having a uniform outer profile with a common radial height and flat top for conventional use in providing a relatively small radial gap with a conventional turbine shroud 44 illustrated in FIG. 3. In this way, both squealer tips 38*a,b* are equally spaced from the shroud 44 for providing an effective fluid seal thereat for reducing leakage of the combustion gas 32 therebetween during operation. And, upon differential thermal expansion of the turbine shroud 44 and blades 10, both squealer tips will rub against the shroud 44 protecting the remainder of the airfoil and tip cap 22 from damage.

Figure 3:
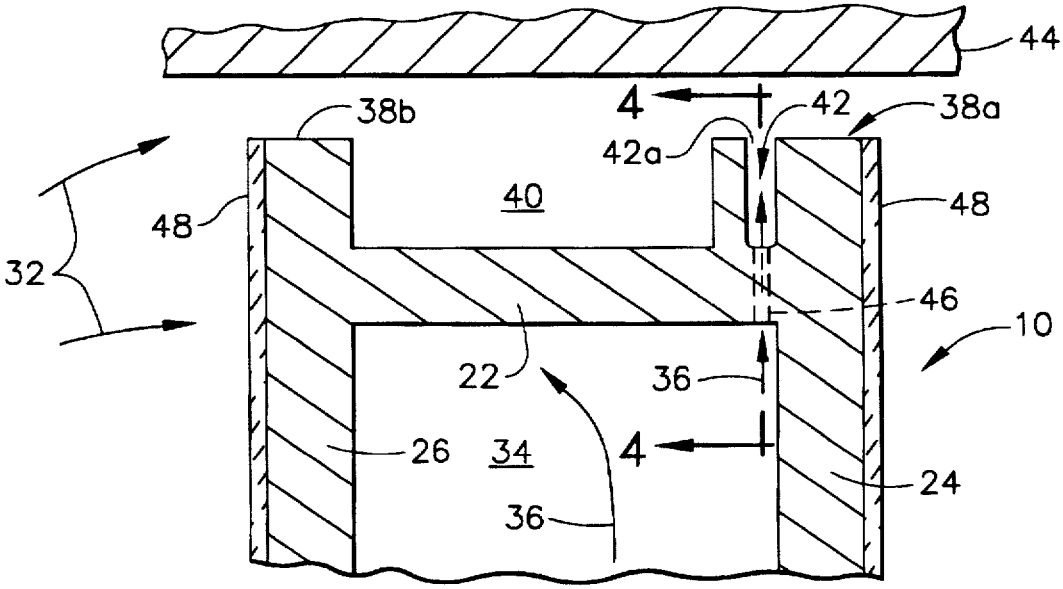
FIG. 3 is a radial elevation sectional view through the blade tip illustrated in FIG. 2 disposed adjacent to a turbine shroud and taken generally along line 3—3.

As shown in FIGS. 2 and 3, a plurality of chordally spaced apart supply holes 46 extend radially through the tip cap 22 in the slot 42 in flow communication with the cooling circuit 34 inside the airfoil 16 for channeling respective portions of the coolant 36 therefrom and into the slot 42 for cooling the pressure squealer tip 38*a* by internal convection.

The slot 42 includes an upwardly facing or radially outer first outlet 42*a* defined by the adjacent inboard and outboard portions of the single pressure squealer tip 38*a*. The adjacent inboard and outboard portions have a common radial height above the tip cap 22. The first outlet 42*a* extends continuously along the full axial extent of the slot 42 between the leading and trailing edges.

The slot 42 also includes an axially aft facing second outlet 42*b*, illustrated in FIG. 2, which is disposed at the airfoil trailing edge 30 for promoting flow of the coolant 36 inside the slot 42 rearwardly for discharge from the second outlet 42*b*.

During operation, the pressurized coolant 36 flows radially upwardly through the several supply holes 46 and into the common slot 42 in the pressure side squealer tip 38*a*. The slot second outlet 42*b* promotes flow of the coolant 36 inside the slot 42 between the leading and trailing edges. In this way, the coolant 36 enjoys increased convection cooling along the inside of the pressure squealer tip 38*a* prior to being discharged from the first and second outlets 42*a,b*. The portion of the coolant 36 which is discharged from the first, or radial outlet 42*a* enters the gap between the blade tip and the turbine shroud 44 and improves sealing effectiveness thereof against leakage of the combustion gas 32 therethrough.

Figure 4:
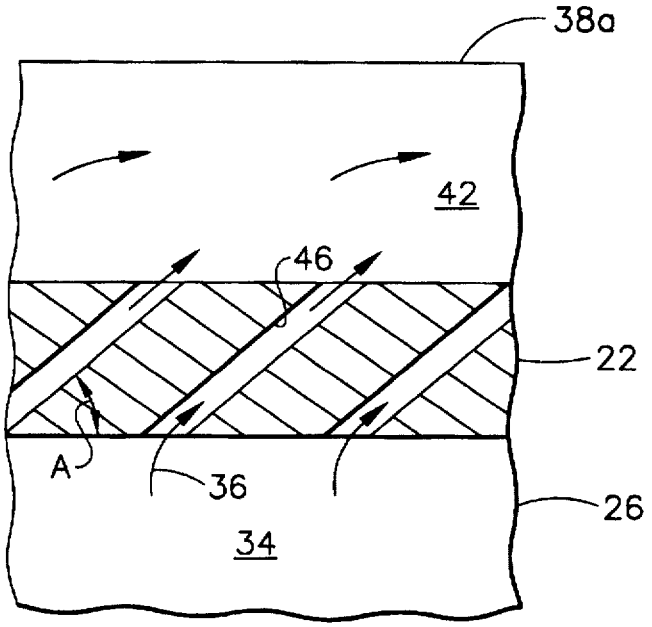
FIG. 4 is a partly sectional view through a squealer tip and slot in accordance with an exemplary embodiment of the present invention as shown in FIG. 3 and taken generally along line 4—4.

As shown in FIG. 2, and in more particularity in FIG. 4, the supply holes 46 are preferably inclined through the tip cap 22 at an acute angle A rearwardly toward the trailing edge second outlet 42*b* for enhancing the rearward flow of the coolant 36 inside the slot 42 for improving convection cooling of the squealer tip. The acute angle A is preferably within the exemplary range of about thirty-forty five degrees. Furthermore, and referring again to FIG. 3, the supply holes 46 are preferably radially coplanar with the slot 42 thereabove for equally distributing the coolant 36 along both lateral surfaces defining the slot 42 and promoting convection cooling thereof.

In this way, enhanced backside cooling of the outboard portion of the pressure side squealer tip 38*a* as illustrated in FIG. 3 may be obtained for providing a desirable temperature gradient therein so that a thermal barrier coating (TBC) 48 may be used to maximum advantage additionally on the squealer tips. The TBC 48 may take any conventional composition, such as zirconia which is a thermally insulating ceramic material. It may now be conventionally applied over the entire outer surface of the airfoil 16 along both pressure and suction sides 24, 26 from the root 18 to the tip including both outboard sides of the squealer tips 38*a,b*.

As shown in FIG. 3, the coating 48 is provided on the pressure squealer tip 38*a* solely on the outboard side thereof coextensively with the pressure side 24 for thermally insulating the pressure squealer tip 38*a* from the combustion gas 32 flowable therealong. In view of the enhanced backside convection cooling provided by the slot 42, the coating 48 preferably extends along the entire outboard surface of the pressure squealer tip 38*a* from the tip cap 22 where it joins the TBC-coated pressure side 24 completely to the top of the squealer tip 38*a*.

Although the pressure squealer tip 38*a* still projects radially upwardly into the combustion gas 32 and is heated thereby, the slot 42 and supply holes 46 now ensure effective backside convection cooling of the outboard portion of the squealer tip 38a which complements the addition of the coating 48 along the outboard side thereof. Since the combustion gas 32 which flows along the coating 48 at the pressure squealer tip 38a is hot, and the coolant 36 channeled through the slot 42 is relatively cool, an effective lateral thermal gradient is created over the entire radial extent of the squealer tip 38a. The relatively large lateral thermal gradient in the squealer tip effects the correspondingly large heat flux between the hot and cold sides of the squealer tip 38a which significantly enhances the performance of the coating 48.

Furthermore, the slot 42 and supply holes 46 are effective for reducing the radial temperature gradient from the top of the squealer tip 38a down to the tip cap 22. By reducing this radial temperature gradient, corresponding thermally induced stress is also reduced for additionally enhancing performance of the blade tip in the vicinity of the pressure squealer tip 38a.

Accordingly, the pressure side squealer tip 38a will have a lower and more uniform temperature as compared to solid squealer tips having a thermal barrier coating, or not. The effectiveness of the thermal barrier coating insulation is enhanced due to the backside cooling inside the slot 42. And, conventional blade tip film cooling holes on the pressure side surface below the pressure squealer tip 38a may be eliminated along with air disruption of the boundary layer flow along the airfoil pressure side 24.

As shown in FIG. 3, the airfoil pressure side 24 at the pressure squealer tip 38a is preferably imperforate without any film cooling holes, and the pressure squealer tip 38a is cooled solely by the slot 42. As shown in FIG. 1, the airfoil 16 may have conventional cooling holes such as film cooling holes 50 provided over various portions of the pressure and suction sides as desired for providing airfoil cooling. The improved pressure side squealer tip 38a, however, is preferably cooled without a corresponding row of conventional film cooling holes immediately below the tip cap 22 in the pressure side 24.

Since the coating 48 illustrated in FIG. 3 may now completely cover the outboard surfaces of the squealer tips, the undesirable masking process described above may therefore be eliminated for reducing the cost of processing the turbine blade. The blade 10 may therefore be manufactured using low cost manufacturing processes to initially cast the turbine blade 10 as a single crystal, nickel-based superalloy component. The slot 42 may be initially cast in the airfoil, or may be subsequently machined therein using conventional processes such as electrical discharge machining (EDM). And, the supply holes 46 may be readily drilled using conventional laser drilling, for example, since they are preferably coplanar with the slot 42 and are therefore readily accessible from above the slot 42. Since the supply holes 46 and slot 42 are coplanar, the angular orientation of the supply holes 46 may also be readily made with suitable alignment of the drilling apparatus through the slot 42.

In the preferred embodiment illustrated in FIG. 2, the slot 42 is provided solely in the pressure side squealer tip 38a which is coextensive with the airfoil pressure side 24. If desired, the suction side squealer tip 38b may also be similarly configured. Since during operation a pressure gradient exists around the airfoil, with greater pressure on the pressure side 24 than on the suction side 26, the trailing edge second outlet 42b of the slot 42 is preferably disposed on the airfoil suction side 26 immediately upstream of the airfoil trailing edge 30 as illustrated in FIG. 2. In this way, the naturally occurring pressure gradient across the blade tip further enhances the axial convection cooling flow of the coolant 36 inside the slot 42 for increasing the relative flow of the coolant 36 out the second outlet 42b as compared to the first outlet 42a.

In the exemplary embodiment illustrated in FIG. 3, the slot 42 extends substantially perpendicularly upwardly from the tip cap 22 to uniformly bifurcate the pressure side squealer tip 38a. Since the supply holes 46 are radially coplanar with the slot 42, the lateral thickness of the outboard portion of the squealer tip 38a is generally equal to the thickness of the airfoil pressure side 24 at the tip cap 22.

Figure 5:
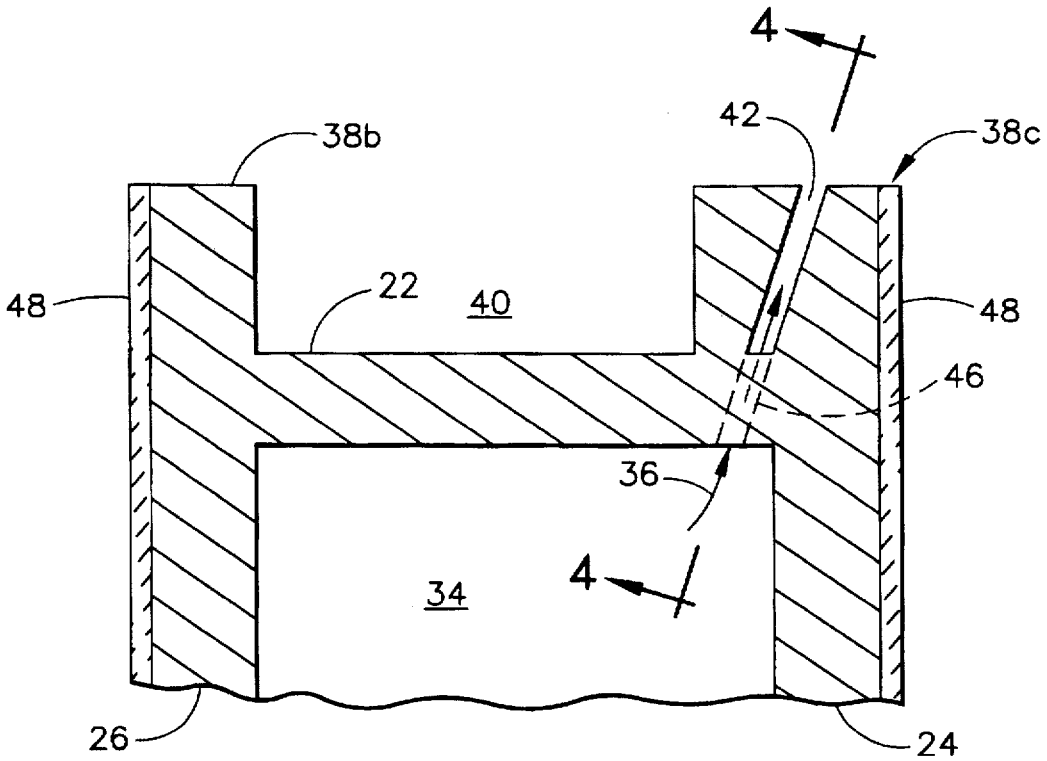
FIG. 5 is a radial elevation sectional view like FIG. 3 illustrating a blade tip in accordance with an alternate embodiment of the present invention.

FIG. 5 illustrates an alternate embodiment of the blade tip wherein the slot 42 extends at an acute angle from the tip cap 22, slightly less than perpendicularly thereto, and preferably extends outboard in the pressure side squealer tip, designated 38c in view of its slightly different configuration. In this way, the supply holes 46 are similarly inclined through the tip cap 22 from the cooling circuit 34 and the thermal mass of the outboard portion of the squealer tip 38c is reduced, with the inboard portion thereof having a correspondingly increased thermal mass. Since the outboard portion of the squealer tip 38c is directly exposed to the hot combustion gas, the decreased thermal mass thereof promotes the effective backside cooling thereof and further enhances performance of the thermal barrier coating 48. The angled slot 42 on the pressure side squealer tip 38c channels the coolant 36 closer to the pressure side tip corner and thereby further reduces the radial thermal gradient in this region for promotion cooling effectiveness.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A turbine blade comprising:

a dovetail for mounting said blade to a rotor disk;

an airfoil having a root joined to said dovetail, a radially opposite tip cap, and laterally opposite pressure and suction sides extending between a leading edge and an opposite trailing edge over which is flowable combustion gas;

said airfoil further including an internal cooling circuit extending from said tip cap to said root and through said dovetail for circulating a coolant therethrough for cooling said blade;

said airfoil additionally including a pair of squealer tips extending radially upwardly from said tip cap along respective ones of said pressure and suction sides, and spaced apart between said leading and trailing edges to define an upwardly open tip cavity;

at least one of said squealer tips having a slot extending radially inwardly from a top thereof to said tip cap, with said slot extending along said at least one squealer tip from about said leading edge to about said trailing edge; and a plurality of spaced apart supply holes extending radially through said tip cap in said slot in flow communication with said cooling circuit inside said airfoil for channeling said coolant therefrom into said slot for cooling said at least one squealer tip.

2. A blade according to claim 1 wherein said slot includes an upwardly facing first outlet defined by adjoining portions of said at least one squealer tip at a common height above said tip cap, and an aft facing second outlet disposed at said airfoil trailing edge.

3. A blade according to claim 2 wherein said supply holes are inclined through said tip cap at an acute angle rearwardly toward said second outlet.

4. A blade according to claim 3 wherein said supply holes are radially coplanar with said slot thereabove.

5. A blade according to claim 4 further comprising a thermal barrier coating disposed on an outboard side of said at least one squealer tip coextensively with a corresponding one of said airfoil sides for insulting said at least one squealer tip from said combustion gas which is flowable therealong.

6. A blade according to claim 5 wherein said thermal barrier coating extends along said outboard side of said at least one squealer tip to said squealer top.

7. A blade according to claim 6 wherein said at least one squealer tip is coextensive with said airfoil pressure side, and said slot second outlet is disposed on said airfoil suction side upstream of said airfoil trailing edge.

8. A blade according to claim 7 wherein said slot extends substantially perpendicularly from said tip cap.

9. A blade according to claim 7 wherein said slot extends at an acute angle from said tip cap.

10. A blade according to claim 9 wherein said slot extends outboard in said pressure side squealer tip for decreasing thermal mass of said outboard portion of said squealer tip.

11. A blade according to claim 7 wherein said airfoil pressure side at said pressure side squealer tip is imperforate, and said pressure side squealer tip is cooled solely by said slot.

* * * * *